United States Patent [19]

Mowbray

[11] Patent Number: 4,475,515

[45] Date of Patent: Oct. 9, 1984

[54] FUEL SYSTEMS FOR COMPRESSION IGNITION ENGINES

[75] Inventor: Dorian F. Mowbray, Burnham, England

[73] Assignee: Lucas Industries Public Limited Company, Birmingham, England

[21] Appl. No.: 408,886

[22] Filed: Aug. 17, 1982

[30] Foreign Application Priority Data

Sep. 5, 1981 [GB] United Kingdom ..... 8126927

[51] Int. Cl.[3] ..... F02M 57/02

[52] U.S. Cl. ..... 123/467; 123/458; 123/459; 239/88

[58] Field of Search ..... 123/467, 459, 458, 447, 123/446, 503; 239/88–93

[56] References Cited

U.S. PATENT DOCUMENTS

| | | | |
|---|---|---|---|
| 2,279,010 | 4/1942 | Nichols | 123/467 |
| 3,810,453 | 5/1974 | Wolfe | 123/467 |
| 4,069,800 | 1/1978 | Kanda et al. | 123/447 |
| 4,080,942 | 3/1978 | Vincent et al. | 123/467 |
| 4,271,807 | 6/1981 | Links et al. | 123/467 |
| 4,359,032 | 11/1982 | Ohie | 123/467 |

FOREIGN PATENT DOCUMENTS

| | | | |
|---|---|---|---|
| 1262089 | 2/1972 | United Kingdom | 123/446 |

*Primary Examiner*—Ira S. Lazarus
*Assistant Examiner*—Magdalen Moy

[57] ABSTRACT

A fuel system for a compression ignition engine comprises a fuel injection nozzle including a fuel pressure actuated valve member biased by a spring contained in a chamber. Fuel is supplied through an inlet passage under pressure from a fuel pump. Valve means is provided which can be opened to spill fuel from the pump. A passage conveys the shock wave resulting from the opening of the valve to the chamber to assist closure of the valve member of the nozzle.

1 Claim, 2 Drawing Figures

FUEL SYSTEMS FOR COMPRESSION IGNITION ENGINES

This invention relates to a fuel system for supplying fuel to a compression ignition engine the system being of the kind comprising a fuel injection nozzle through which liquid fuel can be supplied to a combustion space of the engine, the nozzle including a fuel pressure operated valve member which is lifted from a seating against the action of resilient means to allow fuel flow through an outlet, the system including means for supplying fuel under pressure of the nozzle and valve means operable to reduce the pressure of fuel supplied to the nozzle to terminate the delivery of fuel therethrough.

In such a system the nozzle outlet is in the form of a small drilling or a number of such drillings and when the supply of fuel to the nozzle ceases the valve member of the nozzle should move into contact with the seating as soon as possible to prevent combustion gases flowing through the drilling or drillings. If flow of such gases does take place the drillings and also the space downstream of the seating from which the drillings extend, will become coated with carbon deposits which will impair the operation of the nozzle and hence the fuel system. It is advantageous so far as the performance of the associated engine is concerned to reduce the period of fuel delivery and this is achieved by using high injection pressures with a rapid rate of rise and fall of the pressure. As the pressure falls quickly so the valve member must move quickly into contact with the seating to prevent the flow of combustion gases through the drilling or drillings.

The object of the present invention is to provide a fuel system of the kind specified in a simple and convenient form.

According to the invention in a fuel system of the kind specified passage means is provided and which is connected at one end to downstream of said valve means and at its other end to a chamber into which extends the end of the valve member of the nozzle remote from the seating, whereby the pressure wave generated in said passage means when said valve means is opened, is applied to the valve member of the nozzle to assist the movement of the valve member into contact with the seating.

Two examples of fuel system in accordance with the invention will now be described with reference to the accompany drawings, the two figures of the drawings showing in diagrammatic sectional side elevation, the two forms of the system.

Figure 1:
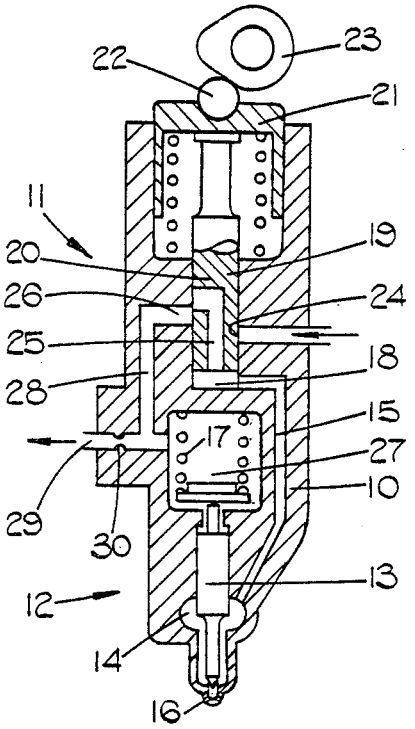

Referring to FIG. 1 of the drawings the fuel system comrises a body 10 in which is located a fuel pump generally indicated at 11 and a fuel injection nozzle generally indicated at 12. The nozzle comprises a valve member 13 slidable within a bore a portion of which is enlarged to form an inlet chamber 14 to which is connected at fuel supply passage 15. The valve member is shaped to co-operate with a seating to control fuel flow from the passage 15 through an outlet indicated at 16. The valve member is biased into contact with the seating by means of a coiled compression spring 17 and it is lifted from the seating by the fuel pressure in the chamber 14. The nozzle is therefore of conventional form.

The passage 15 communicates with a pumping chamber generally indicated at 18, of the fuel injection pump 11. The pumping chamber is formed by the wall of the bore 19 in which is located a pumping plunger 20. The plunger 20 is engaged by and retained relative to a tappet assembly 21 which includes a roller 22 engageable with an engine driven cam 23, the roller being biased into contact with the cam by a coiled compression spring which engages with the tappet assembly.

The bore 19 has a fuel inlet port 24 formed therein and this port communicates with a source of fuel. The port is covered during the inward movement of the plunger and when covered, the fuel in the pumping chamber is pressurised and flows by way of a passage 15 to act upon the valve member 13 of the nozzle. The valve member is lifted from its seating and fuel flows through the outlet 16.

The supply of fuel by the injection pump is terminated when a passage 25 formed in the plunger and communicating with the pumping chamber 18 is uncovered to a spill port 26 which extends into the bore 19. The passage 25 may have a contoured portion whereby the angular position of the plunger 20 determines when the delivery of fuel ceases and hence the amount of fuel supplied by the injection pump. The port 26 communicates by way of a passage 28, with a chamber 27 which accommodates the spring 17 and it also communicates with an outlet 29 through which the spilled fuel can flow to a drain. Conveniently a restrictor 30 is provided upstream of the outlet 29.

In use, when during the inward movement of the plunger 20, the passage 25 is brought into register with the port 26, there will be a sudden increase in the pressure at the port 26. This will create a pressure wave in the passage 28 which will be applied to the chamber 27. The increase in pressure acts upon the end of the valve member 13 remote the seating and assists the action of the spring 17 in moving the valve member towards the seating. The restrictor 30 acts to prolong the application of fuel under pressure to the end of the valve member 13. It will be appreciated that the passage 25 and the port 26 constitute valve means which is operable to terminate the flow of fuel to the engine.

Figure 2:
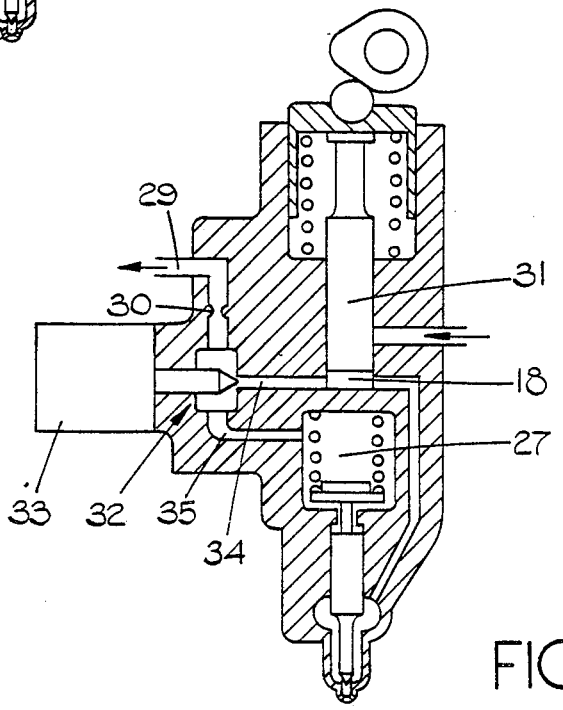

In the arrangement shown in FIG. 2 the plunger 31 is not provided with an internal passage and the valve means is constituted by a spill valve controlled by for example an electro-magnetic device 33. The device 33 is controlled by for example an electronic control system. The spill valve controls the flow of fuel from a passage 34 connected directly with the pumping chamber, into a passage 35 one end of which is connected to the chamber 27 and the other end of which is connected by way of the restrictor 30 to the outlet 29. When the spill valve 32 is opened the pressure wave admitted into the passage 35 causes an increase of pressure in the chamber 27 to assist the movement of the valve member 13 into contact with its seating.

I claim:

1. A fuel system for supplying fuel to a compression ignition engine, the system comprising a fuel injection nozzle through which liquid fuel can be supplied to a combustion space of the engine, the nozzle including a fuel pressure operated valve member which is lifted from a seating against the action of resilient means to allow fuel flow through an outlet, the system including a reciprocable plunger slidable within a bore and defining with the bore a pumping chamber, said chamber communicating with an inlet of the nozzle, a passage extending from said chamber to a drain, an electro-magnetically operable valve means in said passage operable to reduce the pressure of fuel in said chamber, a restriction in said passage downstream of said valve means, and passage means connected at one end to said passage intermediate the valve means and said restriction, the other end of the passage means being connected to a chamber into which extends the end of the valve member of the nozzle remote from the seating, whereby the pressure wave generated in said passage downstream of the valve means when said valve means is opened, is applied to the valve member of the nozzle to assist the movement of the valve member into contact with the seating.

* * * * *